US011708256B2

(12) United States Patent
Votolato et al.

(10) Patent No.: US 11,708,256 B2
(45) Date of Patent: Jul. 25, 2023

(54) BAG CUTTER AND PIERCER

(71) Applicant: Spellbound Development Group, Inc., Newport Beach, CA (US)

(72) Inventors: Earl Votolato, Newport Beach, CA (US); Carlos Reyes, Rancho Santa Margarita, CA (US)

(73) Assignee: Spellbound Development Group, Inc., Newport Beach, CA (US)

( * ) Notice: Subject to any disclaimer, the term of this patent is extended or adjusted under 35 U.S.C. 154(b) by 165 days.

(21) Appl. No.: 16/725,845

(22) Filed: Dec. 23, 2019

(65) Prior Publication Data

US 2020/0131015 A1 Apr. 30, 2020

Related U.S. Application Data

(63) Continuation-in-part of application No. 16/538,562, filed on Aug. 12, 2019, which is a continuation of application No. 14/919,598, filed on Oct. 21, 2015, now Pat. No. 10,377,619, which is a continuation of application No. 14/494,936, filed on Sep. 24, 2014, now Pat. No. 9,221,664, which is a continuation of application No. 13/653,920, filed on Oct. 17, 2012, now Pat. No. 8,869,408, which is a continuation-in-part of application No. 13/546,212, filed on Jul. 11, 2012, now Pat. No. 8,869,407, which is a continuation-in-part of application No. 13/528,473, filed on Jun. 20, 2012, now Pat. No. 8,869,406.

(51) Int. Cl.
*B67B 7/46* (2006.01)
*B26B 27/00* (2006.01)

(52) U.S. Cl.
CPC ..... *B67B 7/30* (2013.01); *B26B 27/00* (2013.01)

(58) Field of Classification Search
CPC ..... B67B 7/30; B26B 27/00; B26B 27/005; B26B 3/08
See application file for complete search history.

(56) References Cited

U.S. PATENT DOCUMENTS

| | | | |
|---|---|---|---|
| 1,082,400 | A | 12/1913 | Burnite |
| 1,216,899 | A | 2/1917 | Weyer |
| 1,553,449 | A | 9/1925 | Kennedy |
| 1,953,564 | A | 6/1934 | Smith et al. |
| 2,033,050 | A | 3/1936 | Pankonin |
| 2,233,497 | A | 3/1941 | Teigen |
| 2,389,648 | A | 11/1945 | Stafford |
| 2,593,601 | A | 4/1952 | Pollak |

(Continued)

FOREIGN PATENT DOCUMENTS

| | | |
|---|---|---|
| CA | 2468050 | 11/2005 |
| GB | 1455919 | 12/1974 |

(Continued)

*Primary Examiner* — Hwei-Siu C Payer
(74) *Attorney, Agent, or Firm* — Fish IP Law, LLP

(57) ABSTRACT

A bag cutter for opening a sealed package using at least one of a blade and a piercer. Preferably, at least one blade is disposed partially within a cutout of an arm in a manner that exposes an edge of the blade. A piercer can comprise an extension of a cutout edge or be located on any other suitable portion of an arm. Another blade can be provided that is substantially perpendicular to the blade within a cutout, and juxtaposable against a cutting surface.

8 Claims, 23 Drawing Sheets

(56) References Cited

U.S. PATENT DOCUMENTS

| | | | | |
|---|---|---|---|---|
| 2,616,436 | A * | 11/1952 | Langley | A45D 29/02 132/75.5 |
| 2,649,656 | A | 8/1953 | Hedrik | |
| 2,674,796 | A | 4/1954 | Herold | |
| 2,681,504 | A | 6/1954 | Fox | |
| 2,881,520 | A | 4/1959 | Mito | |
| 3,047,947 | A | 8/1962 | Spenninger | |
| 3,142,426 | A | 7/1964 | Busse | |
| 3,727,272 | A | 4/1973 | Rhodes | |
| 3,883,953 | A | 5/1975 | Saullo | |
| D235,306 | S | 6/1975 | Christian et al. | |
| D256,883 | S | 9/1980 | Wharmby | |
| 4,455,894 | A | 6/1984 | Roberts | |
| D276,786 | S | 12/1984 | Chen | |
| 4,530,154 | A | 7/1985 | DiCarlo | |
| 4,581,823 | A | 4/1986 | Gilman | |
| 4,711,031 | A | 12/1987 | Annello | |
| D298,210 | S | 10/1988 | Hutson et al. | |
| 4,887,335 | A | 12/1989 | Folkmar | |
| 4,887,355 | A | 12/1989 | Colbert | |
| 5,007,171 | A | 4/1991 | Horning, Jr. | |
| 5,044,081 | A | 9/1991 | Nguyen | |
| 5,103,562 | A | 4/1992 | Braatz | |
| 5,115,568 | A | 5/1992 | Aida | |
| 5,285,577 | A | 2/1994 | Carney et al. | |
| 5,357,679 | A | 10/1994 | Hanna | |
| 5,437,759 | A | 8/1995 | Dieringer | |
| 5,524,348 | A | 6/1996 | Tipp | |
| 5,561,905 | A | 10/1996 | Sherman | |
| D419,417 | S | 1/2000 | Kane | |
| 6,578,243 | B1 | 6/2003 | Hall | |
| 6,587,192 | B2 | 7/2003 | Isozaki et al. | |
| 6,629,327 | B2 | 10/2003 | Adams | |
| 6,658,742 | B2 | 12/2003 | Votolato | |
| 6,966,244 | B2 | 11/2005 | Herbst et al. | |
| 7,073,264 | B2 | 7/2006 | Votolato | |
| D542,104 | S | 5/2007 | Holcomb et al. | |
| D571,180 | S * | 6/2008 | Marshall | D8/98 |
| 7,506,445 | B2 | 3/2009 | Buyse et al. | |
| 7,891,100 | B2 | 2/2011 | Gelardi et al. | |
| D636,248 | S | 4/2011 | Still | |
| 7,958,639 | B2 | 6/2011 | Ireland | |
| 8,069,546 | B1 * | 12/2011 | Whittemore | B26B 3/08 29/408 |
| 8,869,406 | B2 | 10/2014 | Votolato | |
| 8,869,407 | B2 | 10/2014 | Votolato | |
| 8,869,408 | B2 | 10/2014 | Votolato | |
| 9,221,664 | B2 * | 12/2015 | Votolato | B67B 7/30 |
| 10,377,619 | B2 * | 8/2019 | Votolato | B67B 7/30 |
| 2002/0026711 | A1 | 3/2002 | Edwards et al. | |
| 2002/0194734 | A1 * | 12/2002 | Huang | B26B 3/08 30/2 |
| 2005/0102844 | A1 | 5/2005 | Addis | |
| 2006/0196018 | A1 | 9/2006 | Taylor et al. | |
| 2008/0134517 | A1 | 6/2008 | Bosworth et al. | |
| 2010/0077890 | A1 * | 4/2010 | Neiser | B25F 1/00 81/3.09 |
| 2011/0030145 | A1 | 2/2011 | Mandic | |
| 2011/0232103 | A1 * | 9/2011 | Sendel | B26B 3/08 30/152 |
| 2013/0340262 | A1 | 12/2013 | Votolato | |
| 2013/0340263 | A1 | 12/2013 | Votolato | |
| 2014/0013604 | A1 | 1/2014 | Votolato | |
| 2015/0013170 | A1 | 1/2015 | Votolato | |
| 2019/0359465 | A1 * | 11/2019 | Votolato | B67B 7/30 |
| 2020/0131015 | A1 * | 4/2020 | Votolato | B26B 27/00 |

FOREIGN PATENT DOCUMENTS

| | | |
|---|---|---|
| GB | 2234699 | 2/1991 |
| JP | 2000-279659 | 10/2000 |
| WO | 2008/086101 | 7/2008 |

* cited by examiner

BAG CUTTER AND PIERCER

This application is a continuation in part of U.S. application Ser. No. 16/538,562 filed Aug. 12, 2019 now abandoned, which is a continuation of U.S. application Ser. No. 14/919,598 filed Oct. 21, 2015, now issued as U.S. Pat. No. 10,377,619, which is a continuation of U.S. application Ser. No. 14/494,936 filed Sep. 24, 2014, now issued as U.S. Pat. No. 9,221,664, which is a continuation of U.S. patent application Ser. No. 13/653,920, filed Oct. 17, 2012, now issued as U.S. Pat. No. 8,869,408, which is a continuation-in-part of U.S. patent application Ser. No. 13/546,212, filed on Jul. 11, 2012, now issued as U.S. Pat. No. 8,869,407, which is a continuation-in-part of U.S. patent application Ser. No. 13/528,473, filed on Jun. 20, 2012, now issued as U.S. Pat. No. 8,869,406. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is bag cutters.

BACKGROUND

The following background discussion includes information that may be useful in understanding the present invention. It is not an admission that any of the information provided herein is prior art or relevant to the presently claimed invention, or that any publication specifically or implicitly referenced is prior art.

Employment of sealed bags for housing various products is a well-accepted packaging approach. While such bags are highly desirable for their efficiency in maintaining product integrity, access into the contents of such bags is often inconvenient, and contents often spill due to messy cuts and tears.

Various bag cutters are available that attempt to overcome some of the problems described above. Such cutters include the devices described in International Patent Application Publication No. 2008/086101, United States Patent Publication No. 2005/0102844, and U.S. Pat. Nos. 7,073,264, 6,658,742, 4,887,355, and 5,007,171.

Existing bag cutters are not as versatile, durable, or safe as could be desired. Thus, there is still a need for improved cutting devices.

SUMMARY OF THE INVENTION

The inventive subject matter provides apparatus, systems and methods for opening various objects, especially plastic bags, using a cutting device having a blade, a cutout, and a piercer. Devices of the inventive subject matter provide safe, durable, or versatile cutters for a wide range of uses.

Some preferred bag cutters have two arms, which can advantageously be injection molded as a single, continuous piece of plastic. Alternatively, the arms can be two discontinuous pieces of material coupled to a pivot. Some contemplated bag cutters comprise a single arm that comprises all components of the device (e.g., embodiments without an anvil).

In some embodiments having two arms, it is contemplated that one arm partially encloses a blade, and another arm comprises a cutting surface juxtaposable against an edge of the blade.

Contemplated arms have a cutout that partially encloses a blade. Preferably, a piercer, extending from the cutout or any other portion of the cutter, is configured to pierce a bag or other object. Piercers can be used in conjunction with a blade to create a cut, or be used independent of a blade simply to pierce a bag. Piercing a bag can be useful where sealed bags are taken to high elevation locations (to keep them from exploding and creating a mess), where a user wishes to de-puff bags without opening them (e.g., for shipping purposes), and so forth. A piercer can be made of the same piece of material as an arm, or comprise a separate piece of material coupled with the arm.

Bag cutters can have one, two, or even more blades, cutouts, piercers, and cutting surfaces (e.g., anvils, raised portions, or any other surface that could be used in conjunction with an edge of a blade to create a cut). Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Contemplated devices could typically be used in at least two of the following ways: (1) placing a bag between a cutting surface and a blade and squeezing the arms while sliding across the bag; (2) piercing a bag by sliding the piercer through a portion of the bag; (3) sliding a bag through a cutout exposing a blade, or (4) a combination thereof.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
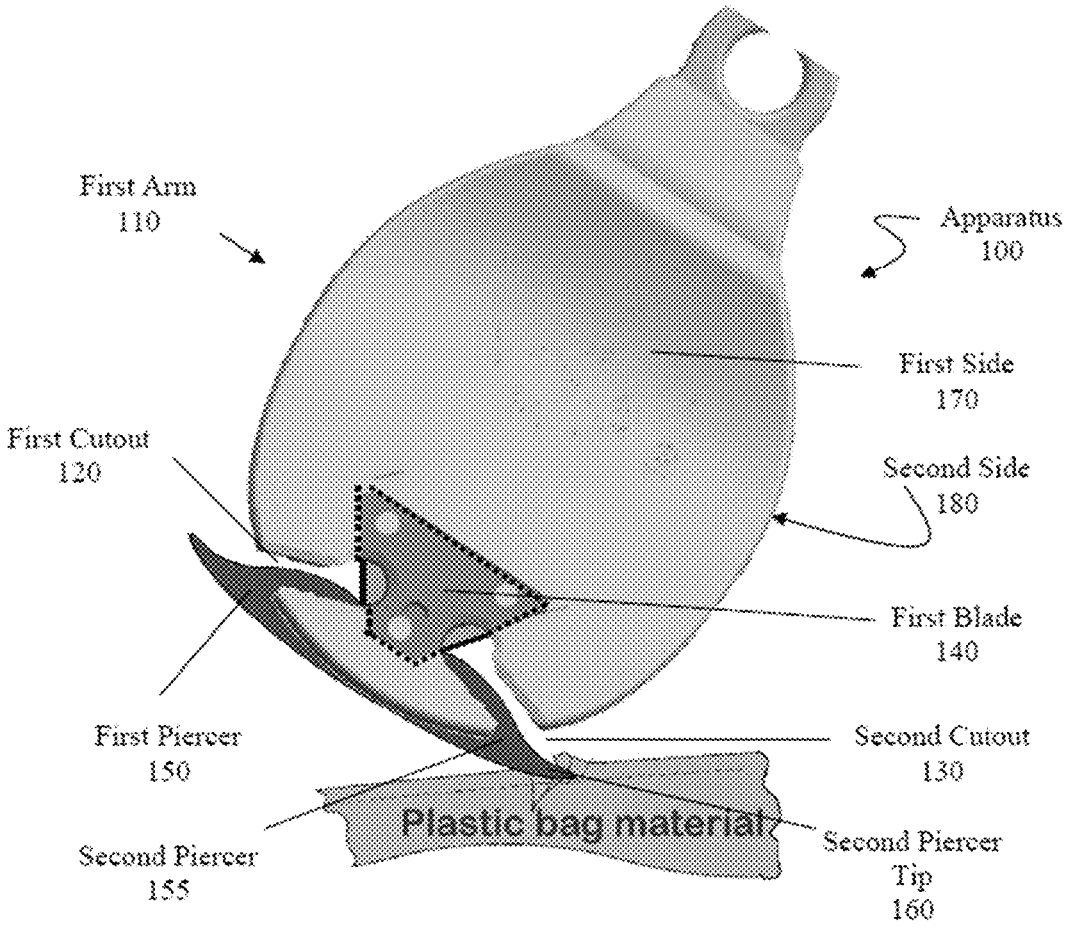
FIG. 1 is a top view of an arm of an open bag cutter having a piercer.

Methods, systems, and devices are contemplated for safely, simply, and efficiently cutting through materials with manual, handheld devices. For example, a cutting apparatus is contemplated with a first arm with an inner surface and an opposed second arm with an inner surface opposite the inner surface of the other arm. A first blade is partially embedded in and extending from the first arm. A cutting surface extends from the second arm toward the first blade, and two piercers extend outward from an edge (e.g., side edge) of the first arm.

In some embodiments, one of the piercers extends at least partially toward the inner surface of the second arm, for example at an angle at least 5°, 15°, 30°, 45°, 60°, 75°, or as much as 90° to the inner surface of the second arm. Either separately or in combination, one of the piercers can extend away from a space between the first and second arms, for example at an angle at least 5°, 15°, 30°, 45°, 60°, 75°, or as much as 90° to a horizontal plane in the space between the two arms. Generally, the two piercers have a substantially mirrored or comparable shape with respect to each other, though it is contemplated the two piercers have different shapes.

A blade is positioned between one of the piercers and the proximal edge of the arm, in some embodiments. Moreover, an additional blade can be positioned between the other piercer and the proximal edge of the arm. Viewed from another perspective, a blade bridges a gap between a piercer and the edge of the first arm, and in some embodiments another blade bridges a gap between another piercer and the edge of the first arm. In perspective, one of the arms has a breadth, and one of the piercers extends beyond or outside the breadth of the arm. Conversely, it is contemplated that a piercer extends approximately within the bounds or breadth of the second arm.

In some embodiments, cutting devices further include a wiper. The wiper extends from the inner surface of an arm toward the inner surface of the opposing arm. The first wiper is typically substantially longitudinal to the inner surface of the arm, though it is contemplated that the wiper is at least 5 degrees askew to longitude of the arm in some embodiments. In some embodiments, the wiper also extends toward one of the blades. Some embodiments also include a second wiper, typically extending from the inner surface of the opposite arm and substantially toward the opposing wiper. Generally, pressing the two arms together juxtaposes at least part of the two wipers. Further, a portion of one of the blades meets a portion of the cutting surface when the two wipers are juxtaposed.

One or both of the wipers is typically greater than approximately 1 inch long, as much as 4 inches long, more than 7 inches long, or as great as 10 inches long. The wipers can be made of rigid, semi-rigid, or flexible materials. Contemplated materials include hard plastics, soft plastics, rubbers, foams, resins, or fibrous materials, or combinations thereof, whether natural or synthetic. Further, wipers typically have a triangular cross section, with a wide base at the surface of an arm extending toward a narrowed tip, though curved (e.g., convex, concave, combination of both, etc.) or blunted cross sections are within the contemplated subject matter. Likewise, wipers can be of the same or different materials, or have the same or different cross sections.

Further cutting apparatus are contemplated, for example having an arm with an inner surface and an opposed second arm with a second inner surface opposite the first. A blade is partially embedded in and extending from the first arm, while a cutting surface extends from the inner surface of the second arm toward the first blade. The apparatus also includes wiper, preferably extending from the inner surface of one arm toward the inner surface of the opposite arm. In some embodiments, the apparatus includes a third arm with an inner surface and an opposed fourth arm an inner surface opposite the third arm inner surface.

A wiper typically extends from the inner surface of the third arm (or fourth arm, or both) toward the inner surface of the opposite arm. In some embodiments, the wiper is positioned substantially longitudinal to the inner surface of the arm, though the wiper can be positioned approximately 5 degrees or more askew to the longitude of the third arm. Devices can also include a second wiper, with the second wiper extends from the inner surface of the other arm (e.g., arm that has a wiper) substantially opposite of the first wiper. In some embodiments, a piercer extends from an edge (e.g., side edge, front edge, etc.) of the third (or fourth) arm. A blade preferably spans the gap between the piercer and the edge of the third (or fourth) arm. A second piercer can also extend from the edge of the third arm, preferably an edge different than the first piercer.

Other cutting apparatus are contemplated, including an arm coupled to and opposite a second arm, with a protrusion extending from the one arm toward a receiving portion of the other arm. The receiving portion has a trough bounded by a lip, with a piercer embedded in the lip and a blade spanning the trough. The protrusion is preferably positioned substantially opposite the piercer, and the piercer typically extends from the lip substantially toward the opposite arm. It should be appreciated that pressing the two opposite arms together abuts part of the protrusion with the lip. Typically, a surface of the protrusion has a ridge or array of surface elements arranged as a gripping surface, for example angular surface elements, rounded surface elements, are a combination thereof.

A second lip bounds the trough in some embodiments, preferably substantially opposite first lip, with a blade spanning between the two lips. Pressing the two arms together draws a material (e.g., plastic, paper, mylar, food stuff container, etc.) into contact with the piercer via the protrusion, in some embodiments such that the piercer pierces through the material. In some embodiments, the material is also drawn into, or at least toward, the trough. The protrusion is typically positioned at a front edge of one of the arms, with the lip positioned at a front edge of the opposite arm, preferably substantially opposite the protrusion. However, the protrusion can also be positioned at a side edge of an arm, while first lip is positioned at a side edge of the other arm and substantially opposite the protrusion.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

FIG. 1 shows a bag cutter having a piercer and two cutouts sharing a blade. Cutting and piercing apparatus 100 comprises a first arm 110 having first and second cutouts (120 and 130, respectively) that share first blade 140. First blade 140 is partially embedded between a first and second side (170 and 180, respectively) of arm 110, and is partially exposed via first cutout 120 and second cutout 130.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Apparatus 100 further comprises a first piercer 150, and second piercer 155 having piercer tip 160 that composes a periphery of first arm 110. Piercers 150 and 155 are made of a single piece of plastic, and attached to second side 180 of first arm 110 such that there is an overlap between first cutout 120 and first piercer 150, and between second cutout 130 and second piercer 155. This configuration is designed to allow a user to pierce and cut a work-piece (e.g., a bag, a sheet, etc.) with one swipe of the hand.

First and second piercers can comprise a single piece of material (as shown in FIG. 1), or comprise two or more pieces of material. It is also contemplated that an apparatus can have three of more piercers, made of one or more pieces of material. Contemplated piercer materials include, among other things, a plastic, a silicon, a metal, or any combination thereof.

Figure 2:
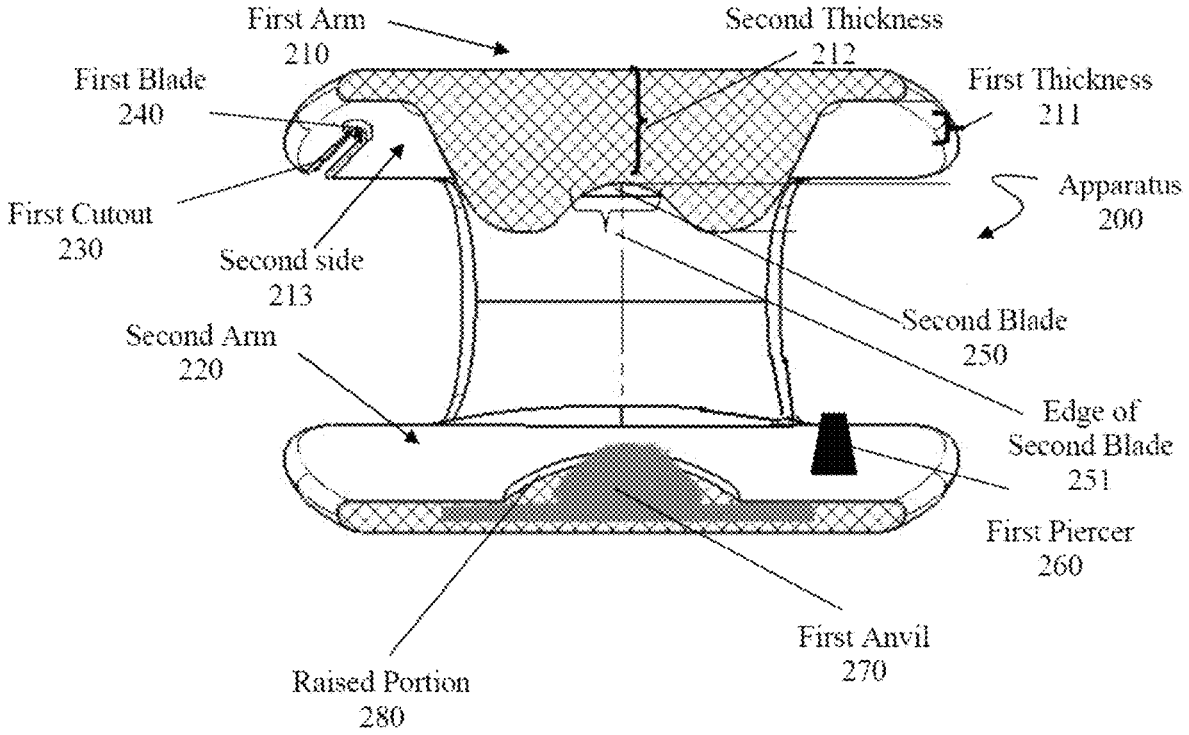
FIG. 2 is a front view of one embodiment of a bag cutter having a piercer, a blade, and an anvil.

FIG. 2 shows a bag cutter having a cutout, anvil and piercer. Apparatus 200 comprises a first arm 210 having first cutout 230, first blade 240 partially embedded therein, and second blade 250. Second arm 220 is continuous with first arm 210 and comprises a first piercer 260, and a cutting surface (first anvil 270 or raised portion 280) configured to juxtapose an edge 251 of second blade 250. First anvil 270 acts as a cutting surface where it extends through a raised portion 280. If anvil 270 wears down (or if anvil was completely embedded within second arm 220), raised portion 280 can become the cutting surface.

Piercer 260 comprises an obtuse (i.e., blunt) tip for safety and utility purposes. However, it is contemplated that piercer could comprise a tip of any suitable size and shape, including for example, a needlepoint (could come with a hard cover), a semi-blunt point, a rounded blunt point, a flat blunt point, or any other suitable shape.

Second blade 250 is partially embedded in first arm 210 in a manner that exposes an edge of blade 250. Unlike first blade 240, which is disposed between a first and second side of first arm 210, second blade 250 extends beyond at least one of the first and second sides. In other words, while an edge of first blade 240 is within a thickness 211 of first arm 210, an edge of second blade 250 sticks out from first arm 210.

It is contemplated that an arm could have multiple and varying thicknesses. A "side" of an arm is a surface that comprises one side of all thicknesses thereof. Thus, a "side" is not always a flat surface. For example, first arm 210 comprises a first thickness 211, and a second thickness 212 (among others). The first side (not shown) is substantially flat, while the second side 213 is substantially flat up to an edge portion, which comprises many curvatures.

Each arm can comprise one or more components. For example, a blade juxtaposable against a raised portion or anvil can be coupled with (e.g., partially embedded in) one material of an arm, such as a hard plastic, that is directly coupled with another material of an arm, such as a soft plastic.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 3:
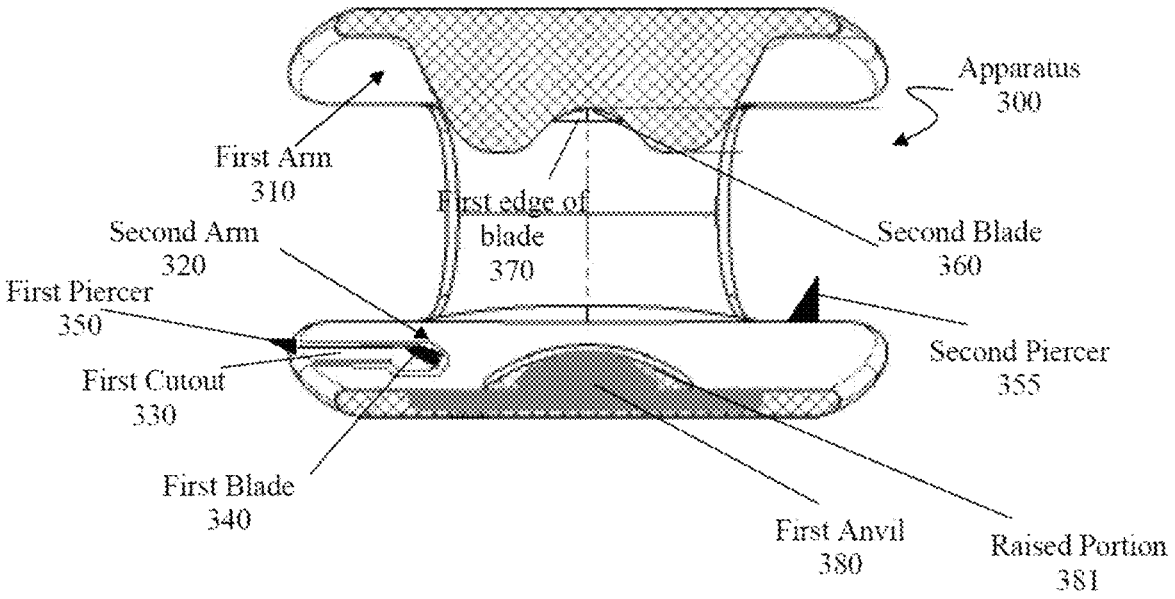
FIG. 3 is a front view of a different embodiment of a bag cutter.

FIG. 3 shows a bag cutter having a cutout, anvil, and multiple piercers. Unlike the apparatus 200 of FIG. 2, apparatus 300 comprises an anvil 380 that is completely embedded in a raised portion 381 of second arm 320. In such an embodiment, raised portion 381 acts as a cutting surface at least up to a point where raised portion 381 is worn and first anvil 380 is exposed. Where first anvil 380 becomes exposed, it will act as a cutting surface.

First arm 310 comprises a second blade 360 partially embedded therein and exposing a first edge 370. Second arm 320 comprises a first cutout 330 at least partially enclosing first blade 340, and having a first piercer 350. Second arm further comprises second piercer 355 that is distal from each of the first blade 340 and second blade 360.

It is contemplated that any arm can comprise any component of a cutting apparatus in any suitable combination. Thus, anvil(s), cutout(s), blade(s), piercer(s), and any other component can be located on any arm or arms.

Figure 4:
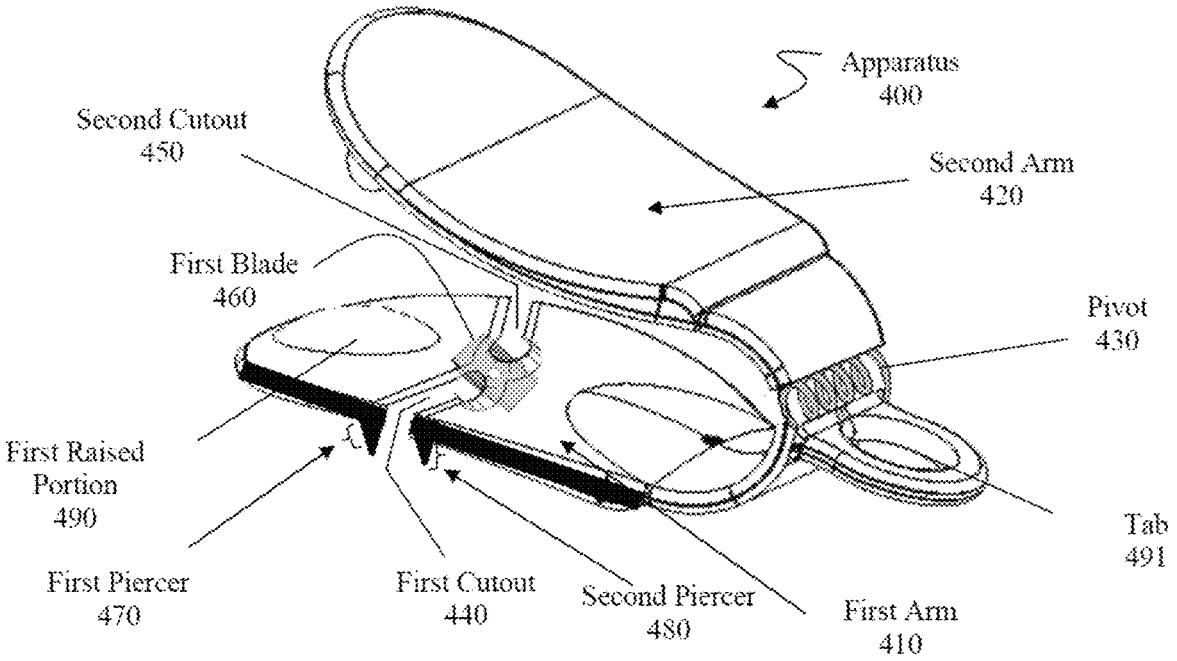
FIG. 4 is a side, rear perspective view of yet another embodiment of a bag cutter.

FIG. 4 shows a bag cutter having a pivot, two cutouts, and piercers extending from the cutouts. Apparatus 400 comprises a second arm 420 having a blade (not shown), coupled to first arm 410 via a pivot (e.g., a coil, a piece of material, a bend, a magnetic strip, or any other suitable pivot). First arm 410 comprises first and second cutouts (440 and 450, respectively), each of which expose an edge of first blade 460. First arm 410 further comprises first and second piercers (470 and 480, respectively), which are extensions of edges of first and second cutouts. Raised portion 490 is configured to juxtapose an edge of the second arm 420's blade when first arm 410 and second arm 420 are squeezed together.

In some other embodiments, first arm is continuous with second arm via a single piece of shared material.

A hanger accepter (e.g., tab 491) can be located on any portion of any arm or pivot and can be configured to accept a hook or other hanger. It is also contemplated for a bag cutter to have various safety features, including, for example, a locking strap, and a ridge in one or both of the arms to help prevent a user's fingers from sliding off the arm.

Figure 5:
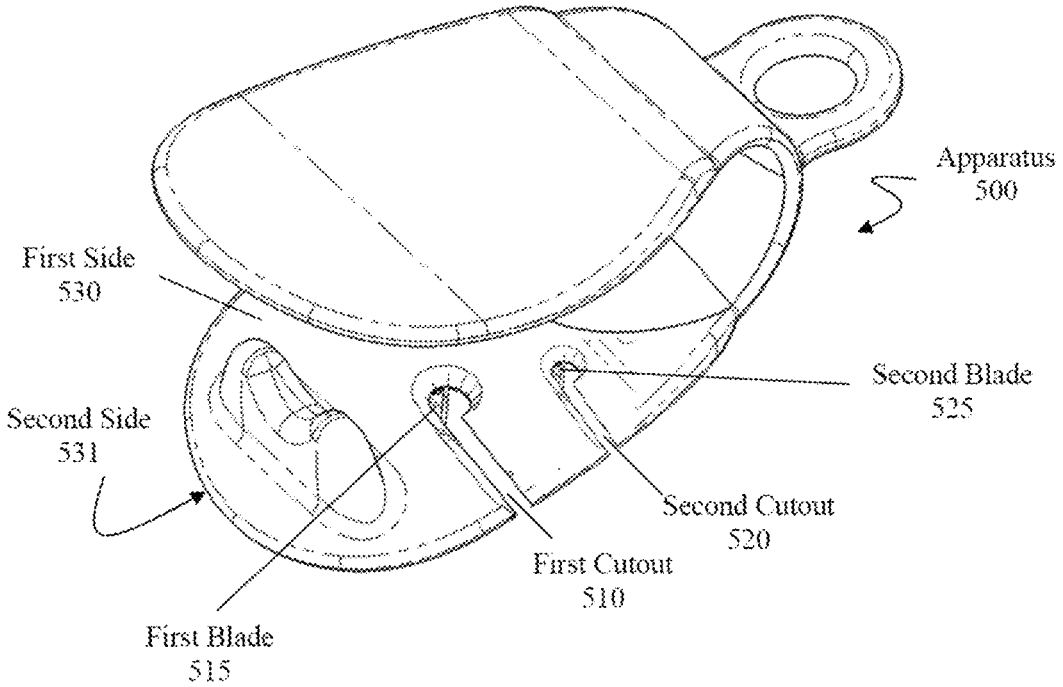
FIG. 5 is a top perspective view of another bag cutter.

FIG. 5 shows apparatus 500 having first cutout 510 and second cutout 520, each partially embedding a different blade. First cutout 510 partially embeds and exposes first blade 515, and second cutout 520 partially embeds and exposes second blade 525. Each blade, 515 and 525, is disposed between first side 530 and second side 531, such that the only way to access either blade is via a cutout.

Blades can be made of any suitable material, including steel, ceramic, and plastic, and can have flat, concave or convex edges. Blades made with one or more non-optimal materials can optionally have suitable coatings, including for example Teflon™ or other friction-reducing coating, and metal coatings or other corrosion-resistance coatings. Stops can be included to control cutting depth. Each blade is preferably embedded in such a way that at least a portion of an edge of a blade is exposed at all times.

Figure 6:
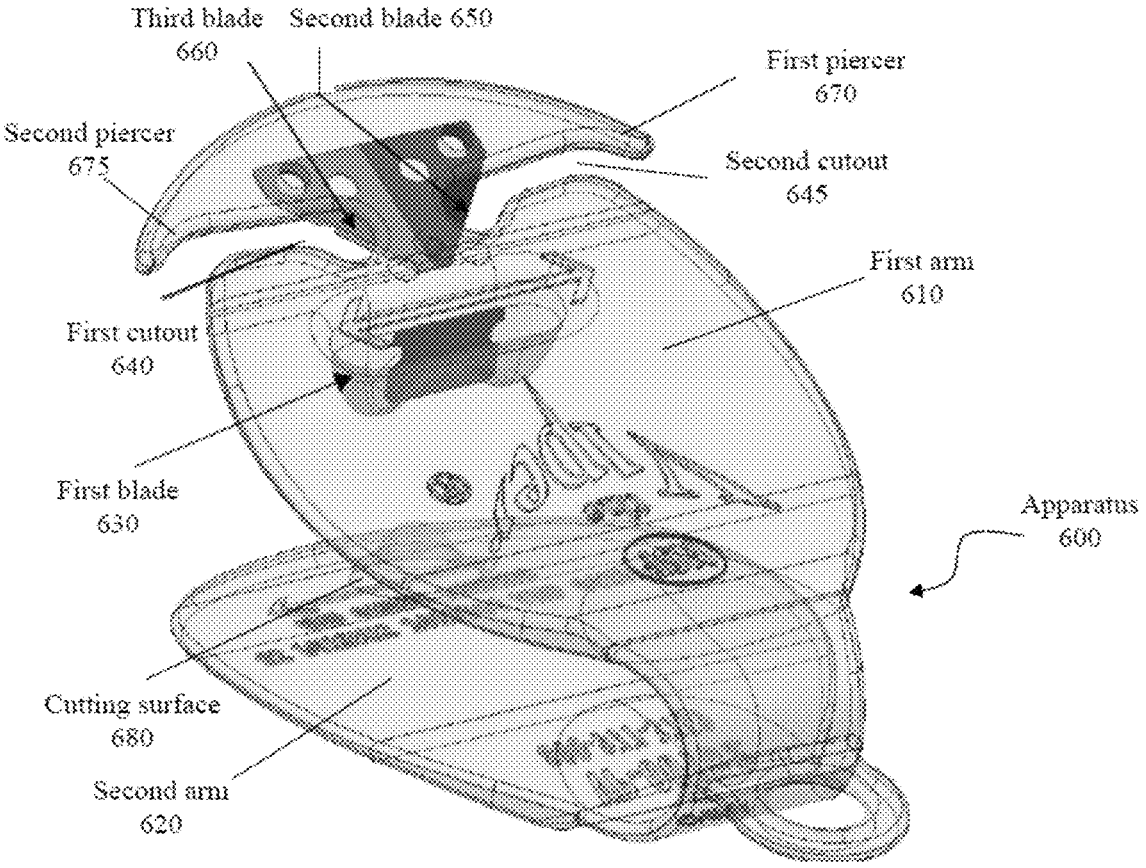
FIG. 6 is a side, rear perspective view of an embodiment of a bag cutter having three blades.

FIG. 6 shows an embodiment of the inventive subject matter having three blades, two cutouts, a cutting surface, and two piercers. Apparatus 600 is a versatile bag cutter and piercer that is configured to allow a user to open different types of bags and other objects. The first arm 610 comprises three different blades, 630, 650, and 660. First blade 630 is partially embedded in first arm 610 and configured so that an edge of first blade 630 can juxtapose cutting surface 680 of second arm 620 when first arm 610 and second arm 620 are squeezed together. Second blade 650 and third blade 660 are each disposed between a first side and a second side of first arm 610. In this embodiment, an edge of second blade 650 is exposed via second cutout 645, and an edge of third blade 660 is exposed via first cutout 640. In some embodiments, it is contemplated that a single blade could comprise two or three edges that can be exposed via two or three different cutouts, respectively.

Apparatus 600 further comprises a first piercer 670 and second piercer 675. A piercer can be used to pierce one side of a bag, so that a bag can be opened on a single side. In other words, a strip of the bag does not need to be removed in order to open a bag. Instead, a user can simply pierce one side of the bag and create a cut using a cutout and corresponding blade edge.

Figure 7:
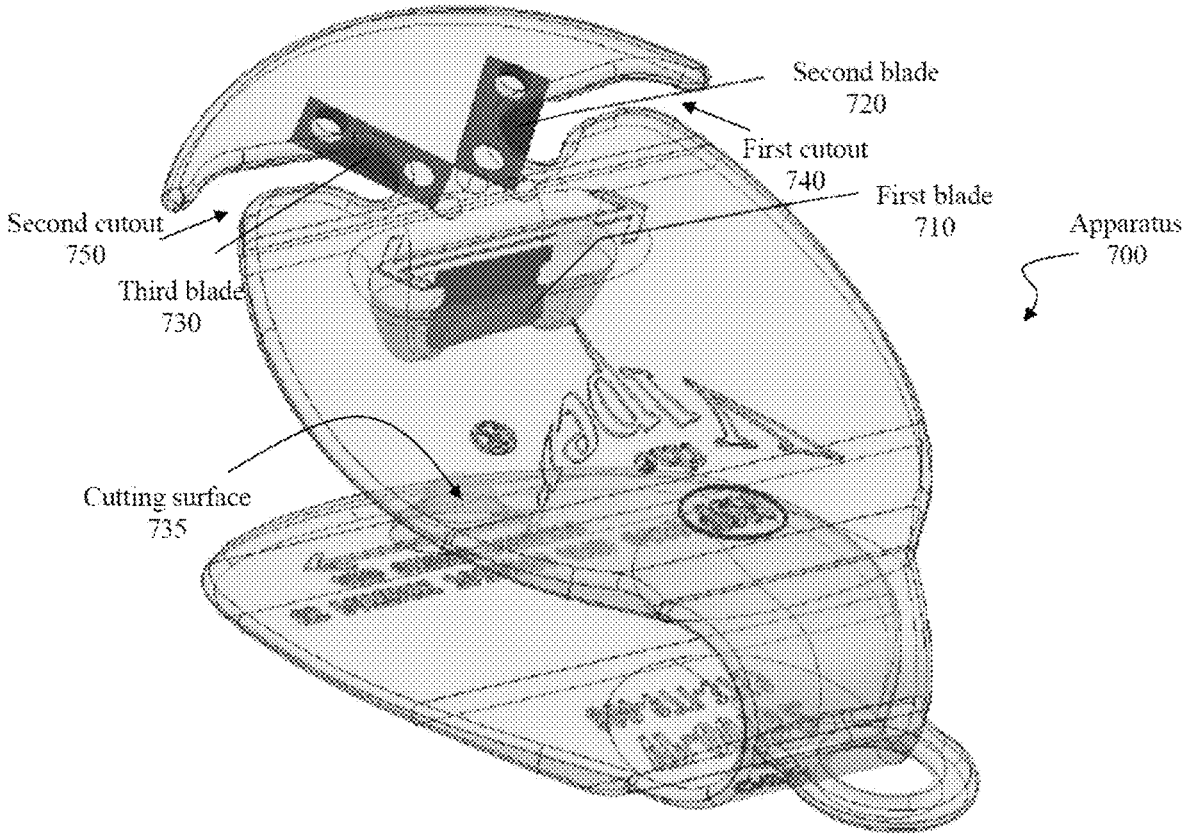
FIG. 7 is a side, rear perspective view of an embodiment of another bag cutter having three blades.

FIG. 7 shows another embodiment of the inventive subject matter. Apparatus 700 is similar to apparatus 600 and comprises three separate blades (710, 720, and 730). First cutout 740 and second cutout 750 expose a portion of second blade 720 and third blade 730, respectively. In this embodiment, second blade 720 and third blade 730 are rectangular in shape. However, it is contemplated that a blade can comprise any suitable size and shape, including for example, a trapezoid, or a triangle.

Figure 8:
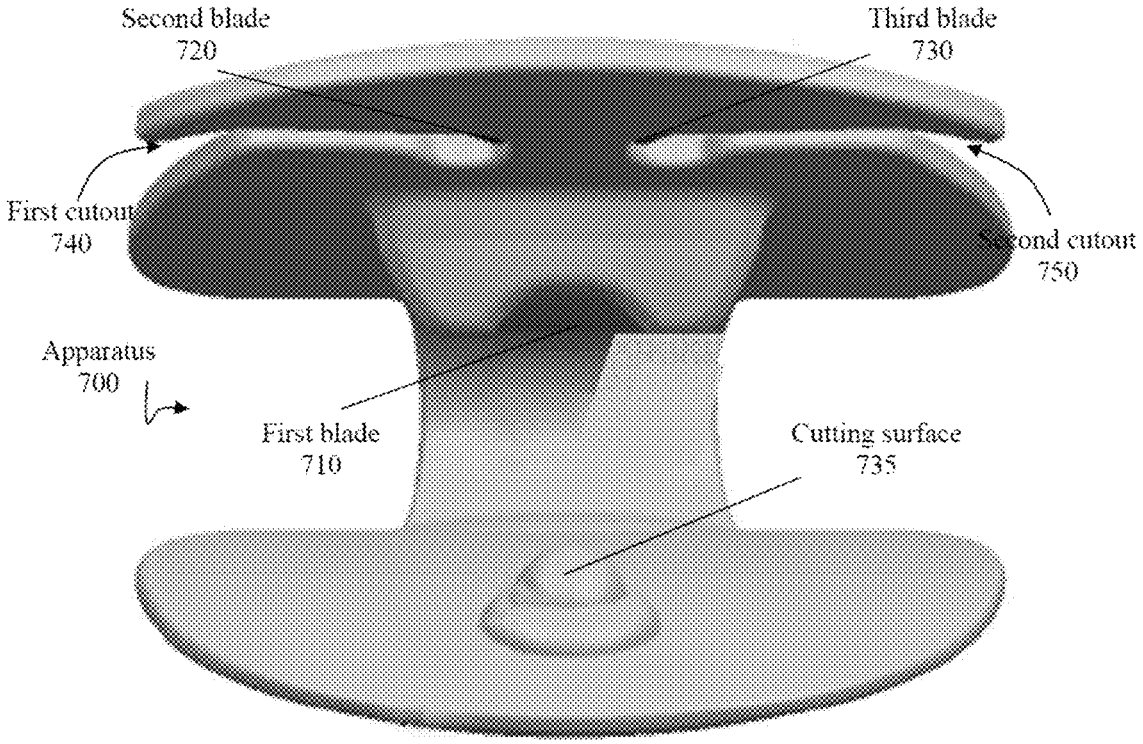
FIG. 8 is a front perspective view of the bag cutter of FIG. 7.

Apparatus 700 further comprises cutting surface 735, configured to juxtapose an edge of first blade 710 when apparatus 700 is squeezed together. FIG. 8 is a front perspective view of the apparatus of FIG. 7.

Figure 9A:
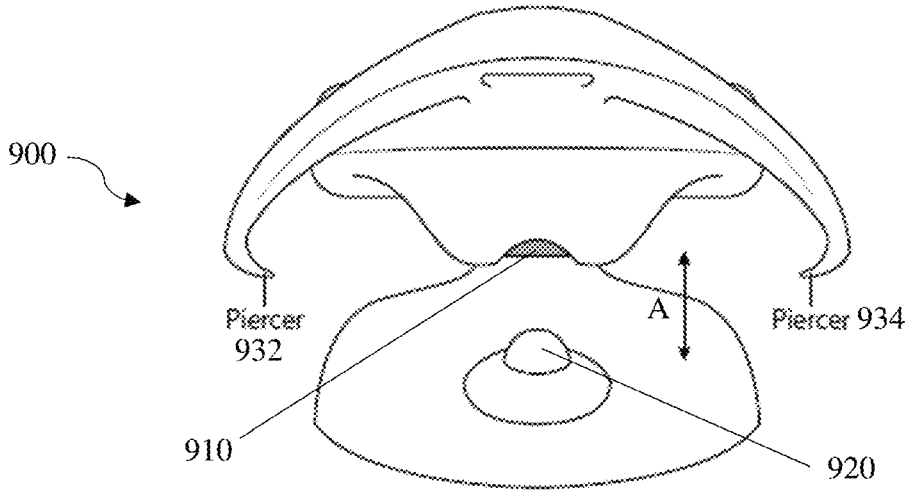
FIGS. 9A-C are perspective views of a yet another bag cutter of the inventive subject matter.
Figure 9B:
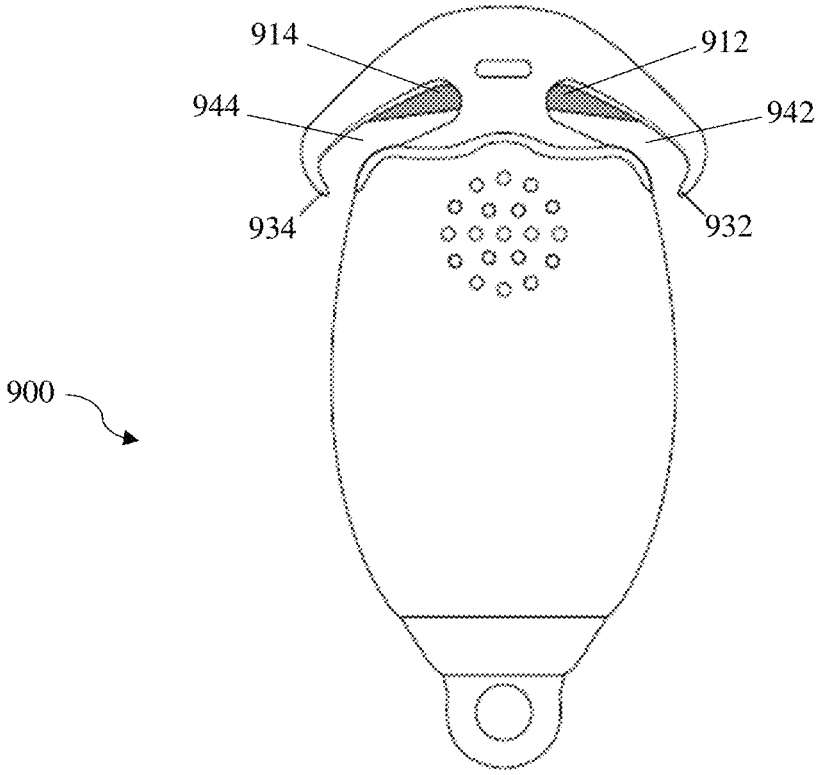
Figure 9C:
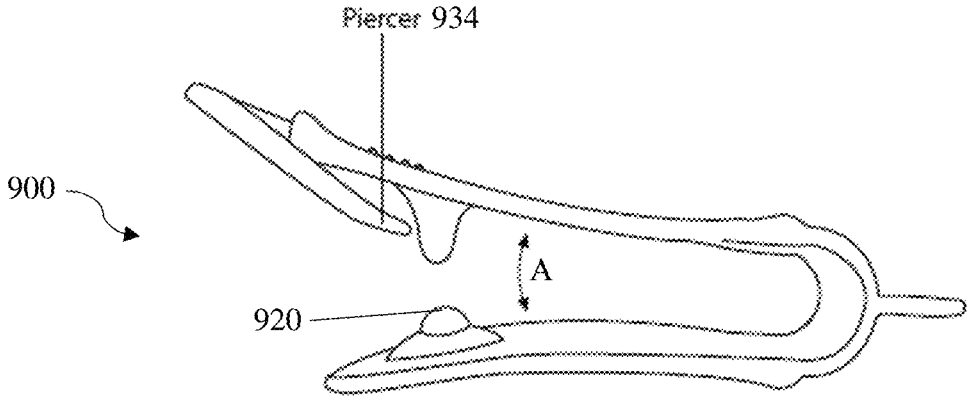

FIGS. 9A-C show an embodiment of the inventive subject matter similar to that of FIGS. 6-8, having three blades, two cutouts, a cutting surface, and two piercers. Apparatus 900 includes blade 910 substantially opposite of cutting surface 920 and configured to juxtapose cutting surface 920 when apparatus 900 is in a closed conformation, for example when apparatus 900 is flexed in back and forth in the direction of arrow A. Comparing apparatus 900 with apparatuses 600 and 700, it should be apparent that piercers 932 and 934 curve and extend toward cutting surface 920 (viewed from another perspective, toward the lower arm) and generally inward.

FIG. 9B depicts apparatus 900 from a top perspective view, showing that piercers 932 and 934 curve toward the apparatus. FIG. 9B further depicts blades 912 and 914, similar to blades as described above (e.g., blade 720 and 730 of FIG. 8, etc.). It should be noted that blades 912 and 914 are positioned such that the blade edges are substantially horizontal, with an acute angle between the blades of 20°, 15°, or 10°, or less degrees, or straight or nearly straight angle. Similarly, it should be noted that the arms of piercers 932 and 934 are relatively narrow and spaced from the body of apparatus to form cut outs 942 and 944, respectively. Viewed from another perspective, cut outs 942 and 944 are wide enough to allow easy access of thick or bulky material to blades 912 and 914. FIG. 9C further depicts a side perspective view of apparatus 900, clearly showing piercer 934 and (not pictured) piercer 932 extend generally downward toward cutting surface 920.

Figure 10A:
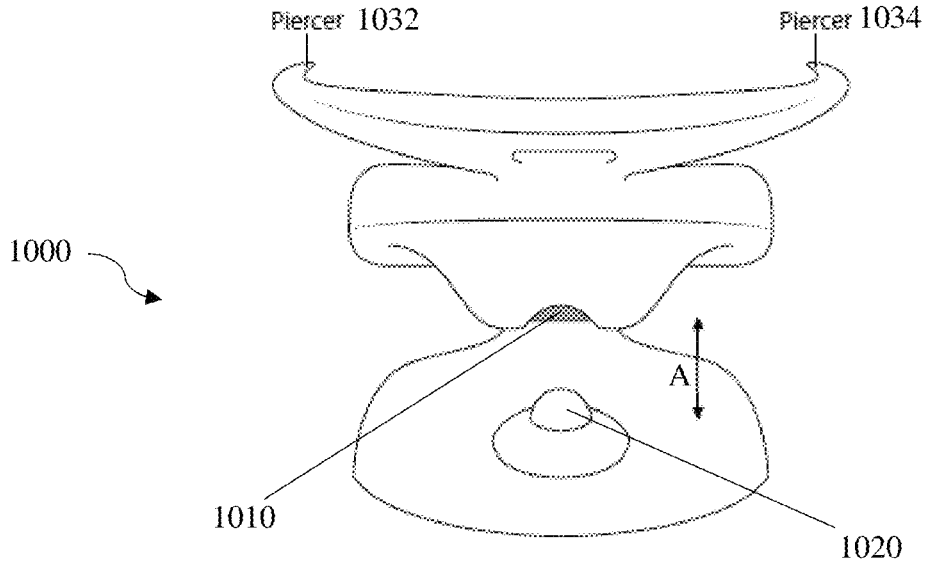
FIGS. 10A-C are perspective views of a still another bag cutter of the inventive subject matter.
Figure 10B:
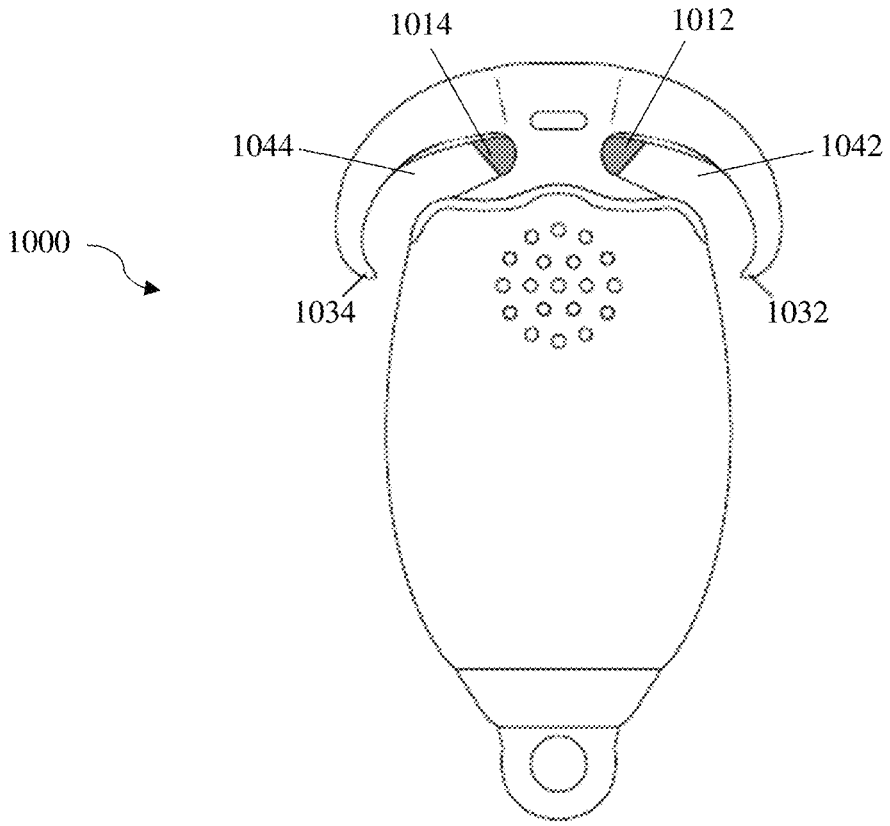
Figure 10C:
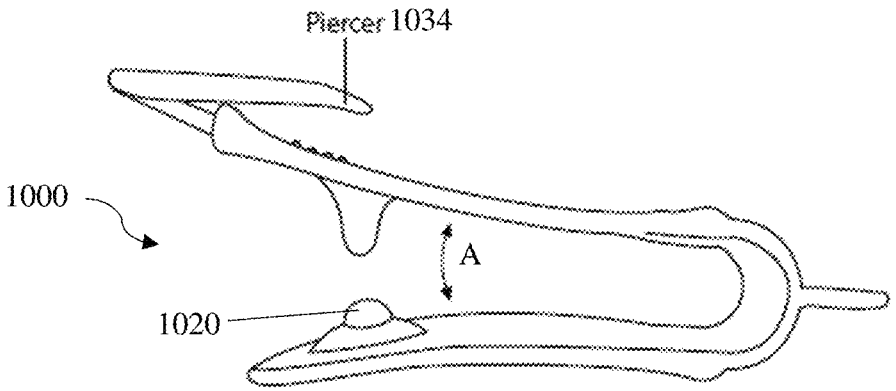

FIGS. 10A-C show an embodiment of the inventive subject matter similar to that of FIGS. 6-8 and 9A-C, having three blades, two cutouts, a cutting surface, and two piercers. Apparatus 1000 includes blade 1010 opposite cutting surface 1020 and as described in FIGS. 9A-C. Comparing apparatus 1000 with apparatus 900, it should be apparent that piercers 1032 and 1034 extend up and away from blade 1010 and cutting surface 1020, and generally inward.

FIG. 10B shows a top perspective view of apparatus 1000, and clearly shows that piercers 1032 and 1034 curve inward toward the apparatus. FIG. 10B further depicts blades 1012 and 1014. Comparing blades of apparatus 1000 with apparatus 900, it should be appreciated that blades 1012 and 1014 are arranged such that the blade edges are substantially 90° to each other, or between 120° and 60°, between 110° and 70°, or between 100° and 80°. Similarly, it should be noted that the arms of piercers 1032 and 1034 are relatively narrow and spaced from the body of apparatus to form cut outs 1042 and 1044, respectively. Viewed from another perspective, cut outs 1042 and 1044 are wide enough to allow easy access of thick or bulky material to blades 1012 and 1014. FIG. 10C further depicts a side perspective view of apparatus 1000, which shows piercer 1034 (and not pictured 1032) extend generally upward from the upper arm and back.

Figure 11A:
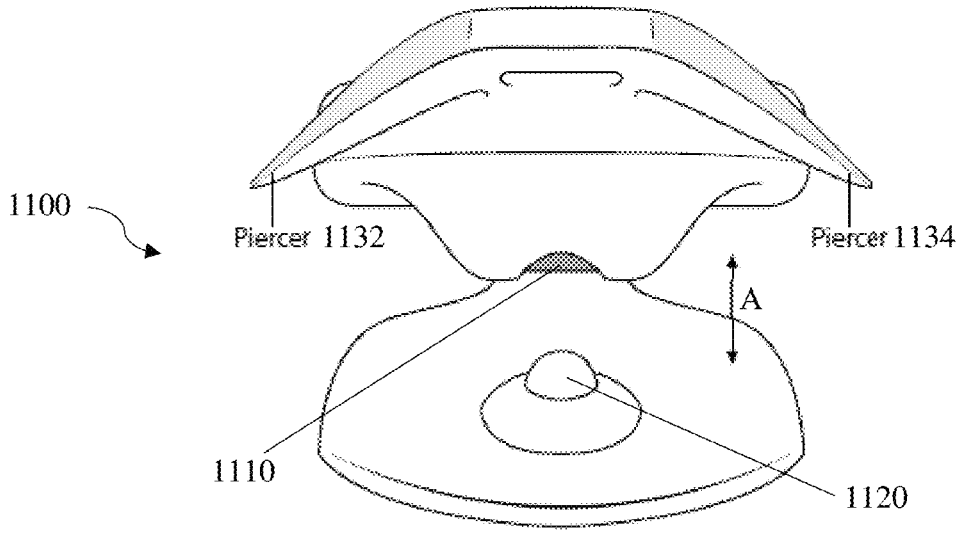
FIGS. 11A-C are perspective views of a further bag cutter of the inventive subject matter.
Figure 11B:
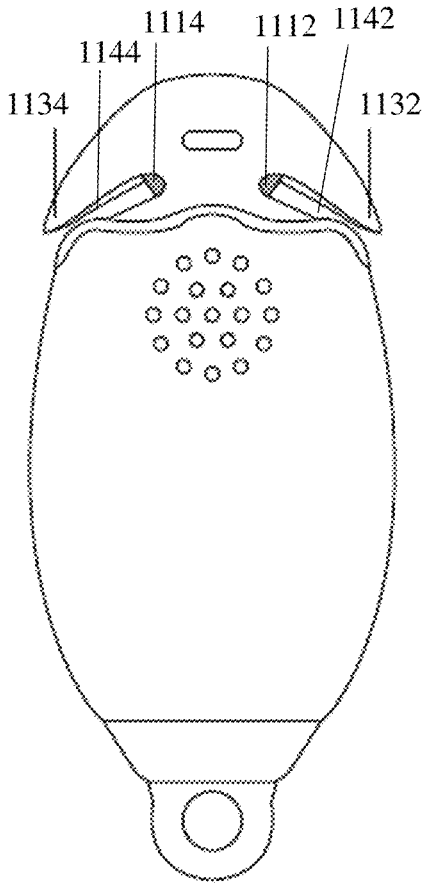
Figure 11C:
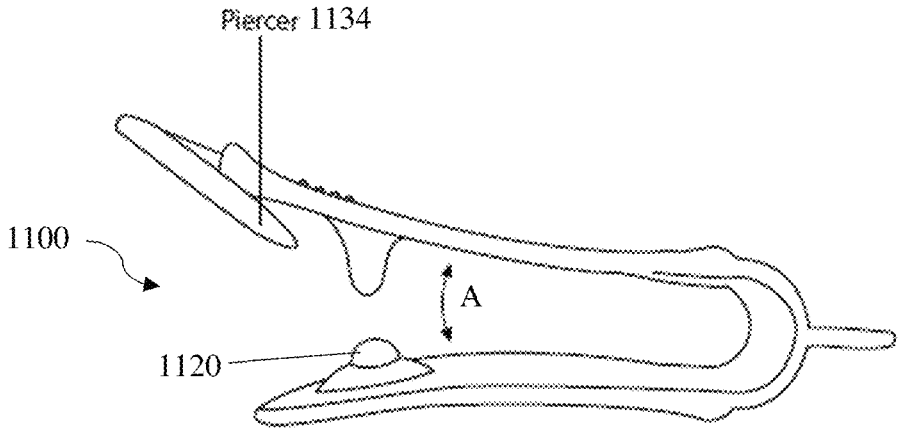

FIGS. 11A-C show an embodiment of the inventive subject matter similar to that of FIGS. 6-8, 9A-C, and 10A-C, having three blades, two cutouts, a cutting surface, and two piercers. Apparatus 1100 includes blade 1110 opposite cutting surface 1120 and as described in FIGS. 9A-C. Apparatus 1100 also includes piercers 1132 and 1134.

As seen in FIG. 11B, piercers 1132 and 1134 extend back and close to the body of apparatus 1100, compared to for example piercers 932 and 934. Likewise, as piercers 1132 and 1134 extend back, down, and relatively close to the body of apparatus 1100, cut outs 1142 and 1144 are less open than for example cut outs of apparatus 900, and as such prevent thick or bulky material from reaching blades 1112 and 1114. It should also be appreciated that the blade edge angle of blades 1112 and 1114 are similar to those of blades 1012 and 1014 of apparatus 1000. FIG. 11C further depicts a side perspective view of apparatus 1100, showing piercer 1134 (and not pictured 1132) extend generally downward from the upper arm and back.

Figure 12A:
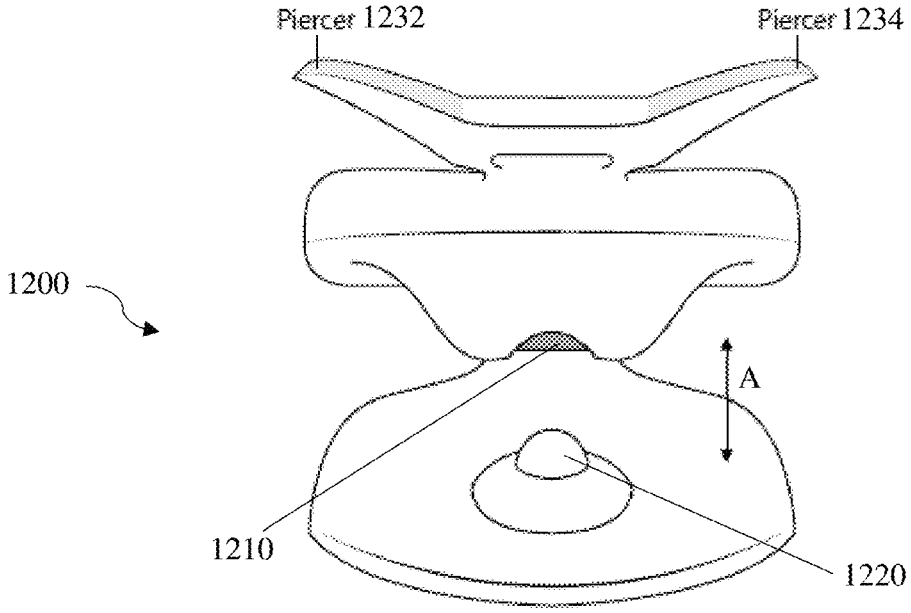
FIGS. 12A-C are perspective views of yet a further bag cutter of the inventive subject matter.
Figure 12B:
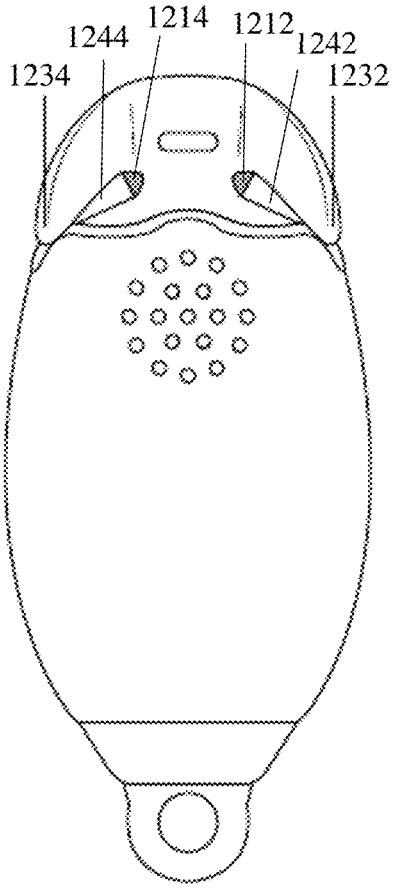
Figure 12C:
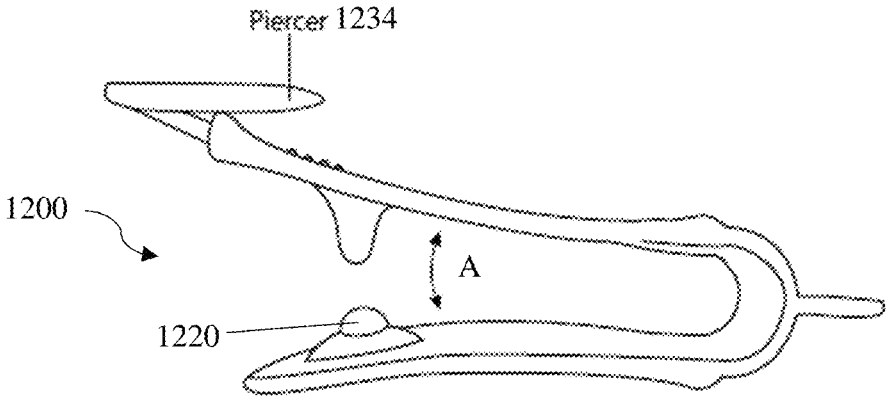

FIGS. 12A-C show an embodiment of the inventive subject matter similar to that of FIGS. 6-8, 9A-C, 10A-C, and 11A-C, having three blades, two cutouts, a cutting surface, and two piercers. Apparatus 1200 includes blade 1210 opposite cutting surface 1220 and as described in FIGS. 9A-C. Apparatus 1200 also includes piercers 1232 and 1234.

FIG. 12B shows piercers 1232 and 1234 extend back and close to the body of apparatus 1200, compared to for example piercers 1032 and 1034. Likewise, as piercers 1232 and 1234 extend back, up, and relatively close to the body of apparatus 1200, cut outs 1242 and 1244 are less open than for example cut outs of apparatus 1000, and as such prevent thick or bulky material from reaching blades 1212 and 1214. It should also be appreciated that the blade edge angle of blades 1212 and 1214 are similar to those of blades 1112 and 1114 of apparatus 1100. FIG. 12C further depicts a side perspective view of apparatus 1200, showing piercer 1234 (and not pictured 1132) extend generally upward or horizontal from the upper arm, and back.

Figure 13A:
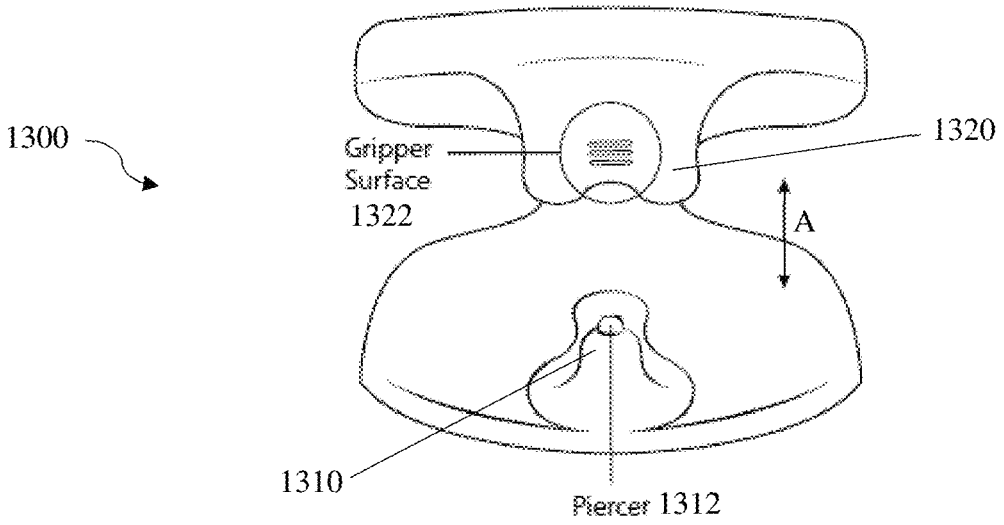
FIG. 13A-B are perspective views of yet a further bag cutter of the inventive subject matter.
Figure 13B:
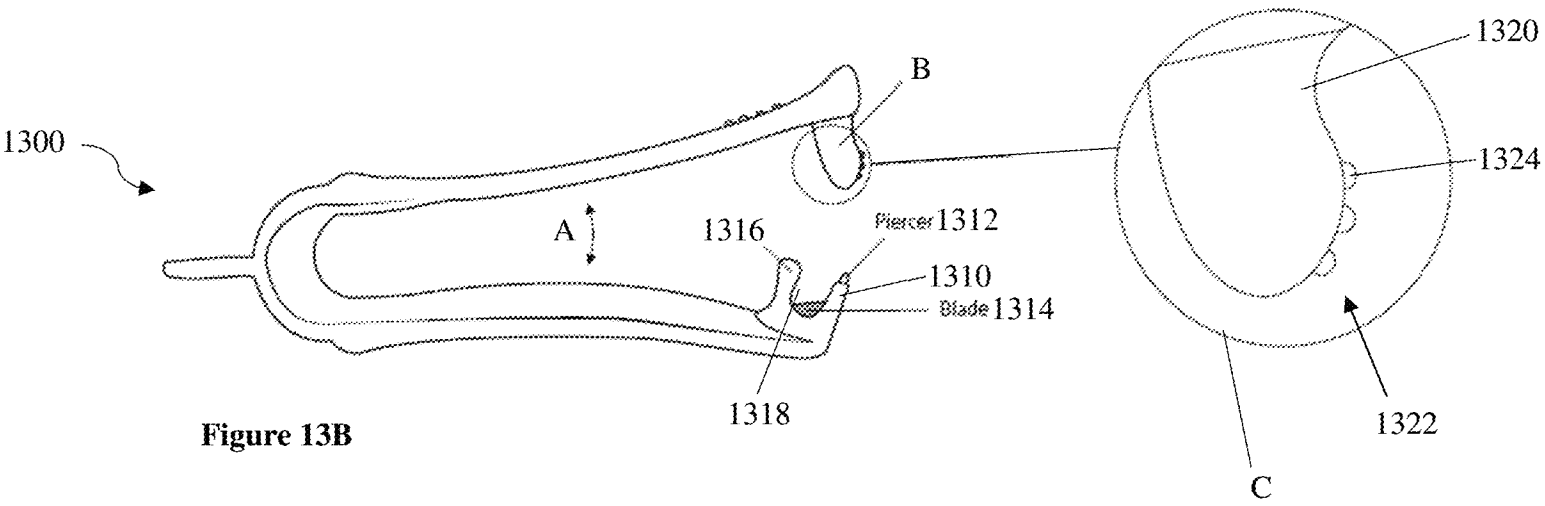

FIGS. 13A-B depict a cutting tool of the inventive subject matter that includes a piercer, a blade, and a material guide on a lower arm, and a pusher and a material gripper on an upper arm. The upper and lower arms of apparatus 1300 move toward each other and away from each other along directional arrow A. Piercer 1312 is seated on the lower arm on base 1310. Gripper surface 1322 is positioned on an exterior face of pusher 1320.

FIG. 13B depicts a side perspective view of apparatus 1300. From this view, the lower arm of the apparatus has base 1310 at a front edge of the arm, with piercer 1312 seated at the top of base 1310. Behind base is material guide 1316, forming cavity 1318 between material guide 1316 and base 1310. Blade 1314 is then disposed at the bottom of cavity 1318 and between base 1310 and material guide 1316. Area B is enlarged to more clearly depict pusher 1320, gripper surface 1322, and a plurality of texture elements 1324 on the upper arm of the apparatus in area C. Area C shows that pusher 1320 includes gripper surface disposed on an outer surface of pusher 1320. As the upper and lower arms of apparatus 1300 are flexed toward each other, it should be appreciated that cavity 1318 and pusher 1320 are preferably shaped such that pusher 1320 at least partially nests or mates with cavity 1320.

Figure 13C:
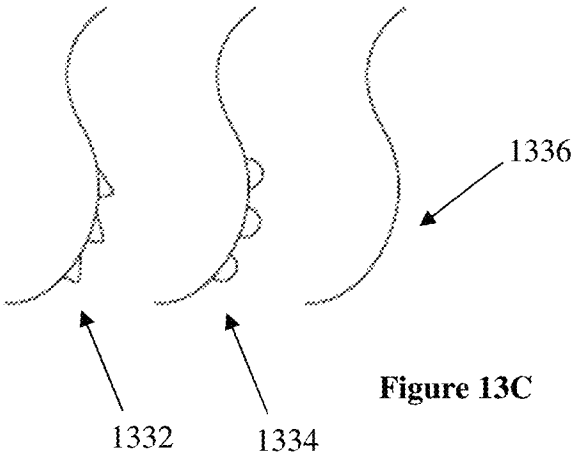
FIG. 13C depicts a view of gripping surfaces for the bag cutter of FIGS. 13A-B.

FIG. 13C depicts several gripper surfaces 1332, 1334, and 1336 that can be used in embodiments of the inventive subject matter, either alone or in combinations thereof. For example, gripper surface 1332 includes angular surface features, while gripper surface 1334 has rounded surface features, while gripper surface 1336 is substantially smooth.

Figure 14B:
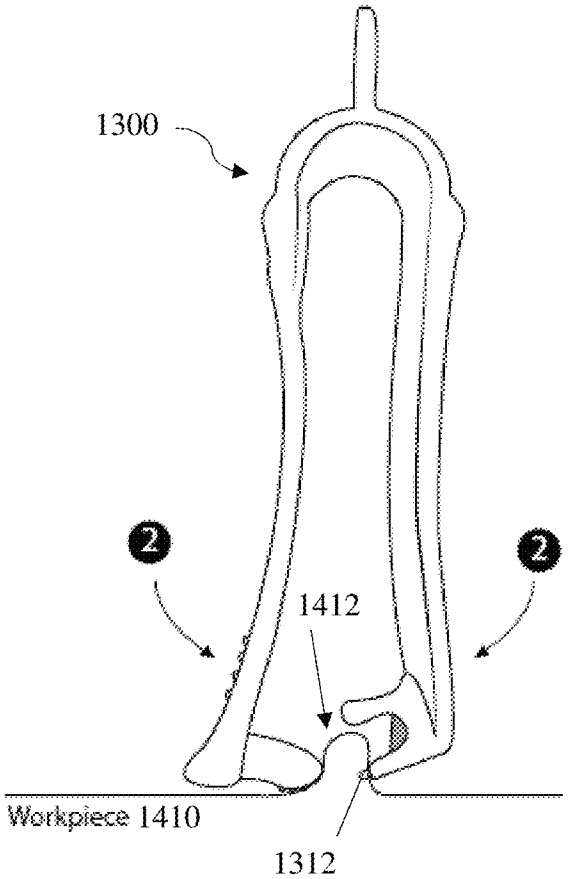
FIGS. 14A-C depict proposed use of the bag cutter of FIGS. 13A-B.
Figure 14A:
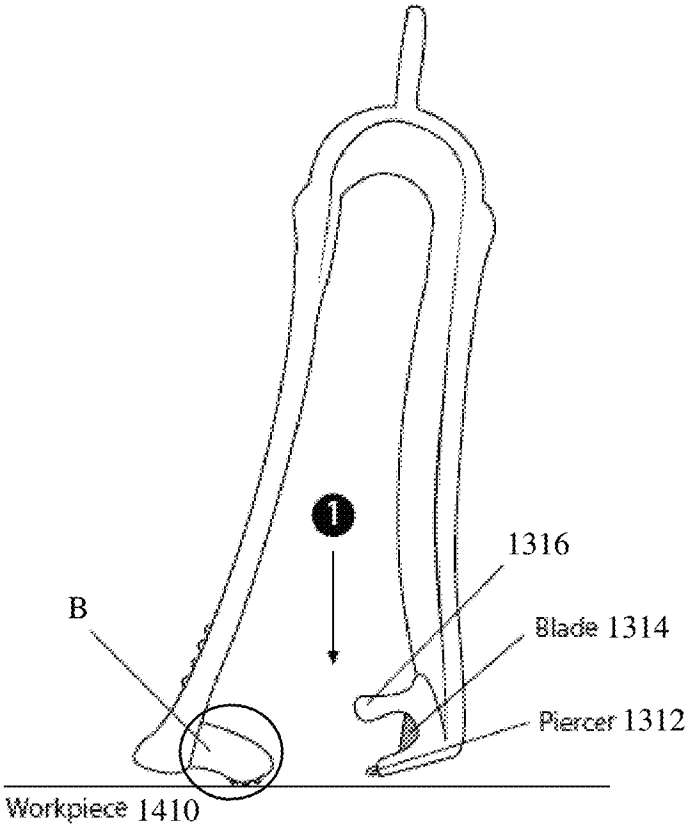
Figure 14C:
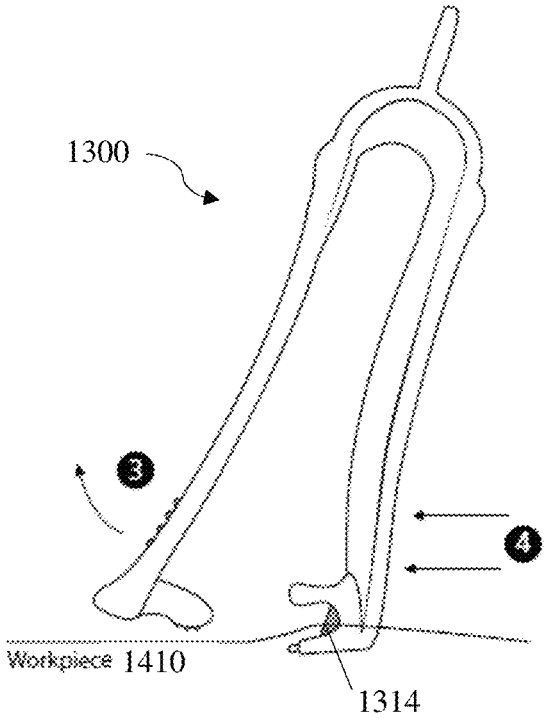

FIGS. 14A-C depict use of apparatus 1300 to cut through workpiece 1410. Workpiece 1410 is a material for cutting as disclosed herein, such as a plastic or paper bag. In FIG. 14A, the front of apparatus 1300 is pressed in the direction of arrow 1 against workpiece 1410, such that area B, including gripping surface 1322, is in contact with workpiece 1410. In FIG. 14B, the arms of apparatus are pressed in the direction of arrow 2 will gripping surface 1322 is pressed against workpiece 1410. This draws portions of workpiece 1410 into wrinkle 1412, allowing piercer 1312 to pierce workpiece 1410. In FIG. 14C, the upper arm of apparatus 1300 is released to move in the direction of arrow 3, and apparatus 1300 is pushed along workpiece 1410 in the direction of arrow 4, such that blade 1314 cuts through workpiece 1410.

Figure 15A:
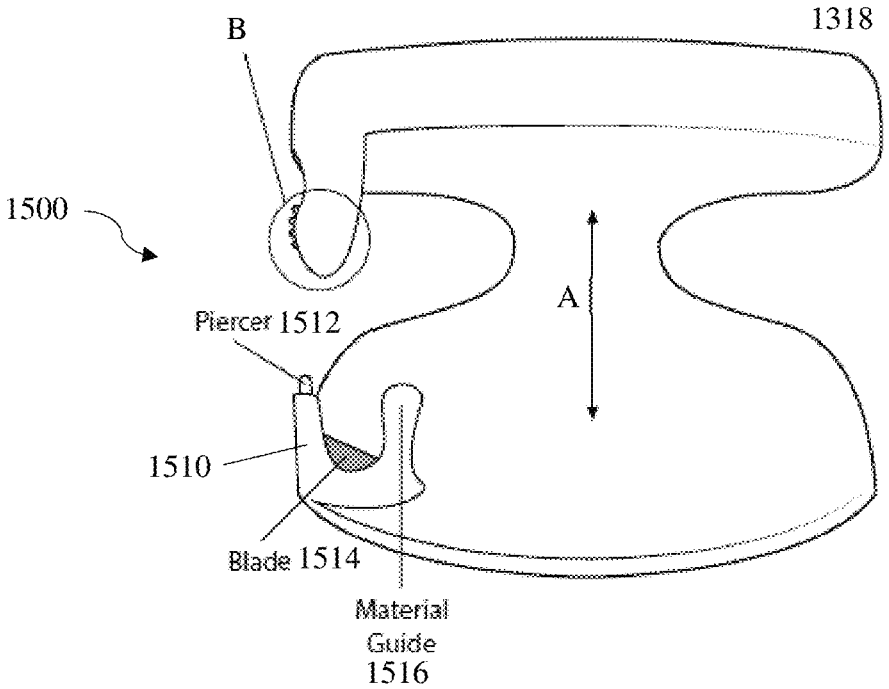
FIGS. 15A-B are perspective views of still a further bag cutter of the inventive subject matter.
Figure 15B:
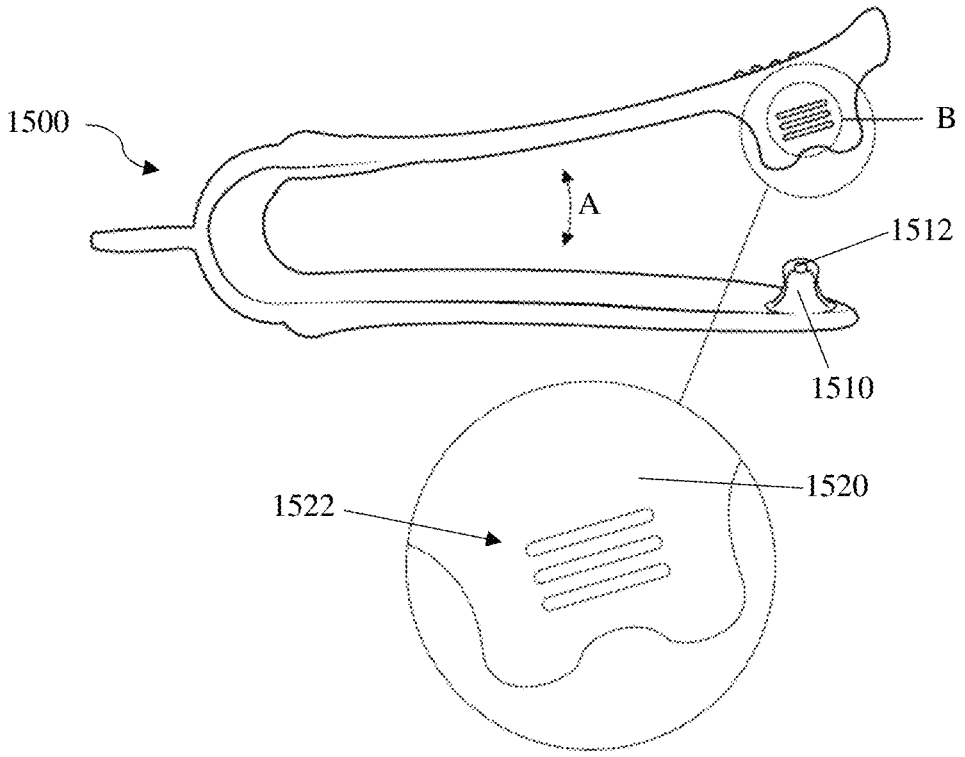
Figure 15C:
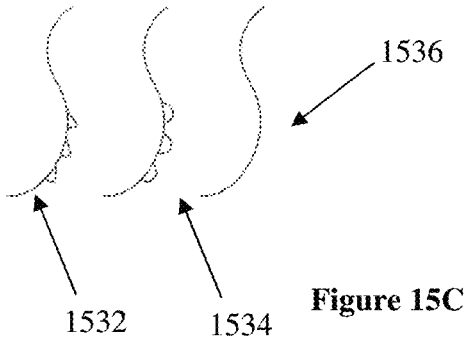
FIG. 15C depicts a view of gripping surfaces for the bag cutter of FIGS. 14A-B.

FIGS. 15A-B depict another embodiment of a cutting tool with a gripper surface, similar to apparatus 1300. In this embodiment, the gripping surface and pusher in region B on the top arm and base 1510, piercer 1512, blade 1514, and material guide 1516 on the lower arm are disposed on the side of apparatus 1500. FIG. 15B depicts a side perspective view of apparatus 1500, more clearly depicting gripper surface 1522 and pusher 1520 in region B. FIG. 15C depicts possible surface textures for gripper surface 1522, including the angular textures of 1532, the rounded textures of 1534, and relatively smooth textures of 1536.

Figure 16A:
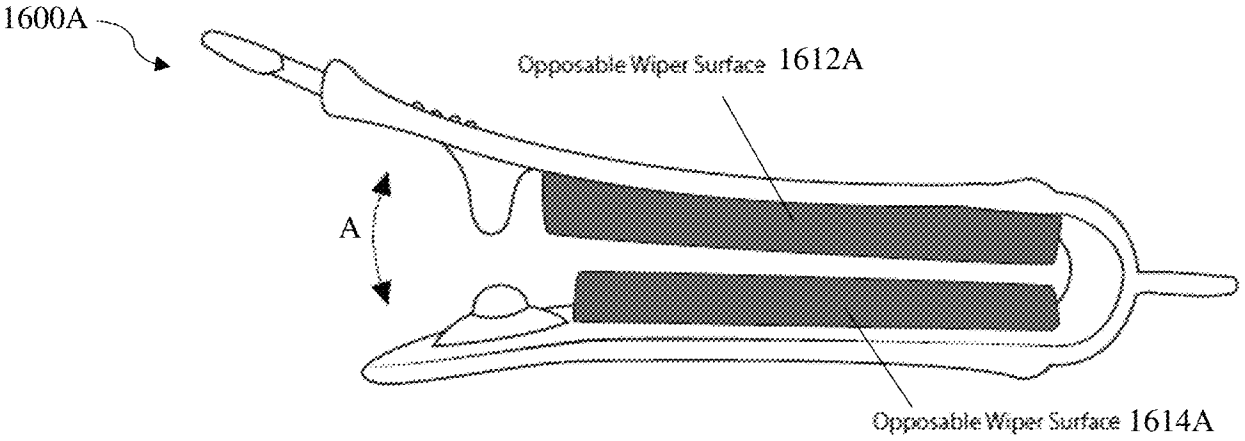
FIG. 16A depicts an embodiment of a bag cutter with dual wipers.

FIG. 16A depicts a cutting device of the inventive subject matter, having three blades, two cutouts, a cutting surface, and two piercers similar to devices described above. Apparatus 1600A further includes opposed wiper surface 1612A disposed on the inner surface of the upper arm, and opposed wiper surface 1614A disposed on the inner surface of the lower arm. Wiper surfaces 1612A and 1614A are preferably made of a rigid or semi-rigid material, for example hard plastic, soft plastic, rubber, or foam. It is also contemplated that wiper surfaces 1612A and 1614A are made of the same or similar material, though in some embodiments the wiper surfaces are made of different materials, for example where wiper surface 1612A is made of a pliant material such as rubber, while wiper surface 1614A is made of a rigid material, such as hard plastic.

In preferred applications, apparatus 1600A is used to open a plastic bag containing a liquid food stuff, for example via one of the piercers or blades. Once the plastic bag is open, the liquid food stuff is emptied from the bag, the bag is placed between opposed wiper surfaces 1612A and 1614A, the two arms are squeezed together in the direction of arrow A, in turn pressing together opposed wiper surfaces 1612A and 1614A. Apparatus 1600A is then drawn along the length of the bag to remove remaining food stuff from the bag.

Figure 16B:
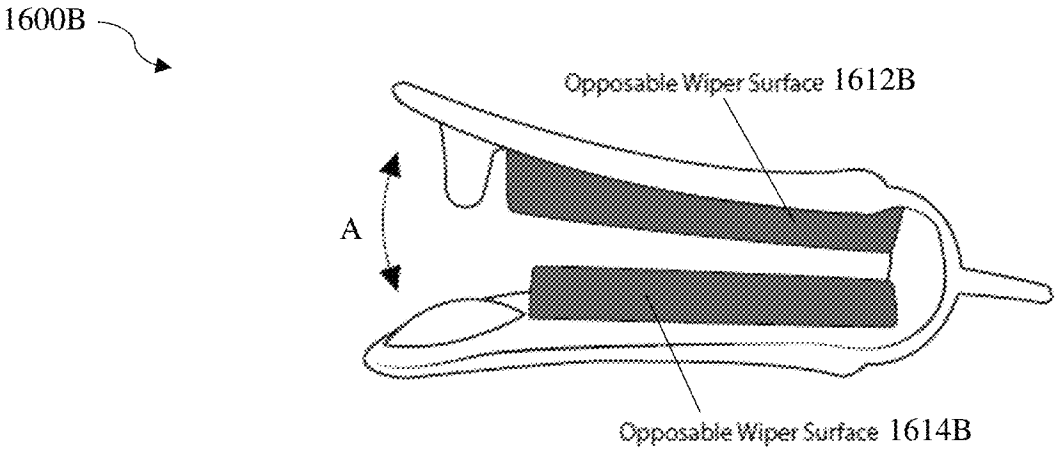
FIG. 16B depicts another embodiment of a bag cutter with dual wipers.

FIG. 16B depicts an additional embodiment of a cutting device, similar to the device of FIG. 16A. However, comparing apparatus 1600B to 1600A, opposed wiper surfaces 1612B and 1614B of apparatus 1600B are shorter than opposed wiper surfaces 1612A and 1614A of apparatus 1600A. Typically, opposed wiper surfaces 1612A and 1614A are more than 4 inches, more than 7 inches, or more than 10 inches long, while opposed wiper surfaces 1612B and 1614B are less than 4 inches, less than 3 inches, or less than 2 inches long. Moreover, it should be apparent that apparatus 1600B does not include piercers, and has a single blade and a cutting surface. However, it is contemplated that shortened opposed wiper surfaces of apparatus 1600B can also be used in cutting devices that include piercers, cut outs, and multiple blades as described above.

Figure 16C:
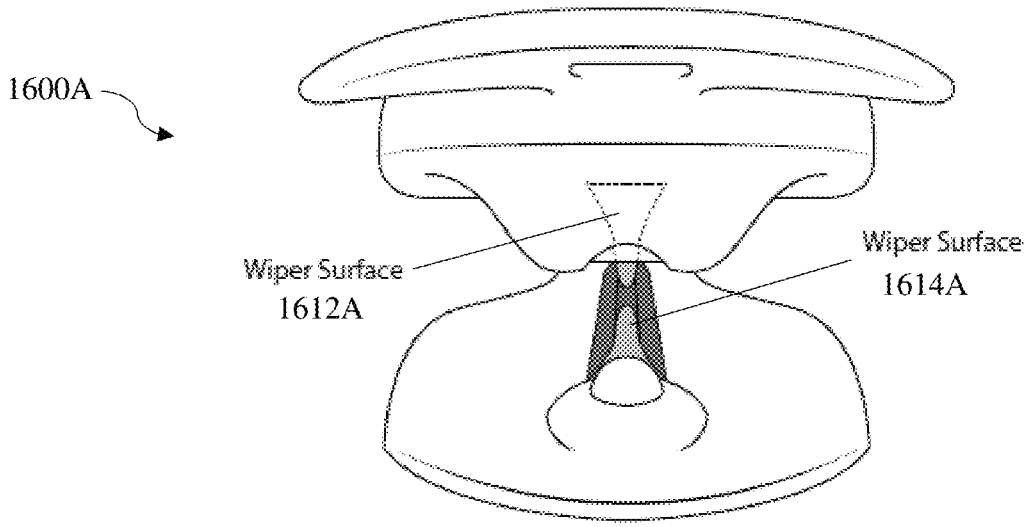
FIG. 16C depicts a front perspective view of the bag cutter of FIG. 15A.

FIG. 16C depicts a front perspective view of apparatus 1600A. From this perspective, it is clear that wiper surfaces 1612A and 1614A are disposed inline, substantially overlapping each other down the center of apparatus 1600A.

Figure 17:
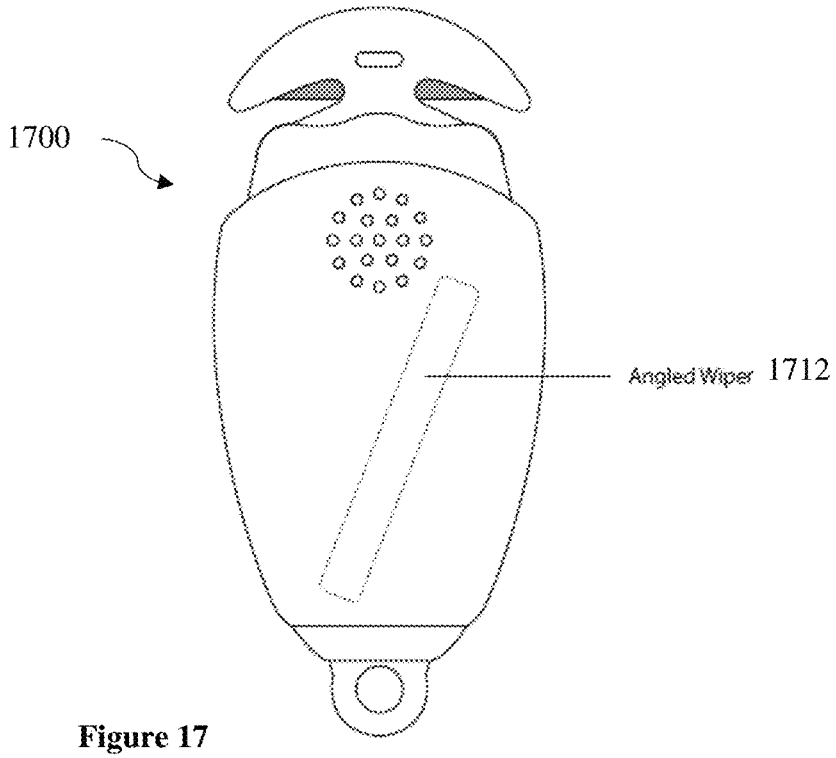
FIG. 17 depicts an embodiment of a bag cutter with an angled wiper.

FIG. 17 depicts another embodiment of a cutting device, similar to apparatus 1600A having two piercers, three blades, two cutouts, and a cutting surface. Apparatus 1700 further includes angled wiper 1712, which is disposed along the inner surface of the upper arm of apparatus 1700. Angled wiper 1712 is disposed at an angle with respect to the center of apparatus 1700, preferably at an angle less than 45°, 30°, 15°, or less than 10°. While a single wiper is depicted in apparatus 1700, it is contemplated that some embodiments use two opposed and angled wipers, disposed inline and substantially overlapping each other.

Figure 18A:
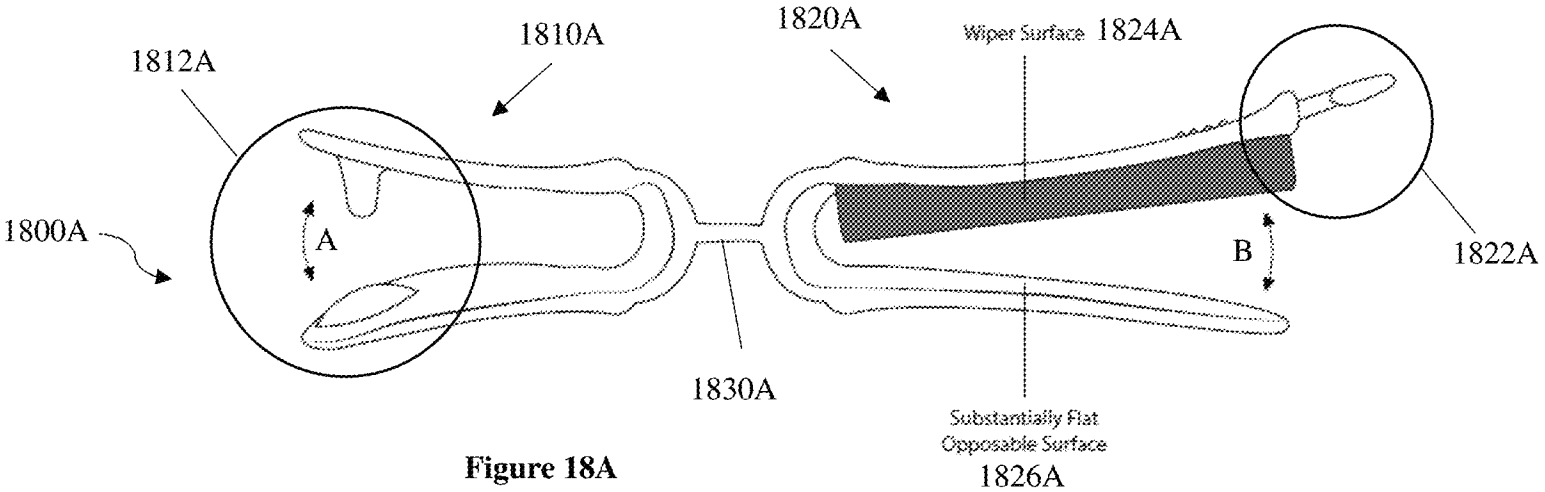
FIGS. 18A-B depicts an embodiment of a bag cutter with a single wiper.

FIG. 18A depicts another embodiment of a cutting device of the inventive subject matter. Apparatus 1800A includes portion 1810A and portion 1820A, connected by connector 1830A. Portion 1810A includes a cutting surface and a blade disposed opposite each other on upper and lower arms of portion 1810A in region 1812A, similar to cutting devices described above. Portion 1820A includes two piercers, two cutouts, and two blades disposed in the cutouts in region

1822A on the upper arm of portion 1820A, similar to piercers as described above. Portion 1820A further includes wiper surface 1824A disposed along the inner surface of the upper arm of portion 1820A. Portion 1820A further includes a substantially flat surface along the inner surface of the lower arm of portion 1820A, opposite of wiper surface 1824A.

It is contemplated that apparatus 1800A be used to open bags holding fluid food stuff. For example, either cutting region 1812A of portion 1810A or piercing region 1822A of portion 1820A could be used to open a bag to remove the food stuff. Once the bag has been emptied, the bag is placed between wiper surface 1824A and opposed surface 1826A of portion 1820, the two arms of portion 1820A are pressed together in the direction of arrow B, and apparatus 1800A is drawn along the bag to remove any remaining food stuff, as described above. Such embodiments provide separate use of the cutting application of region 1812A and the extraction application of wiper surface 1824A.

Figure 18B:
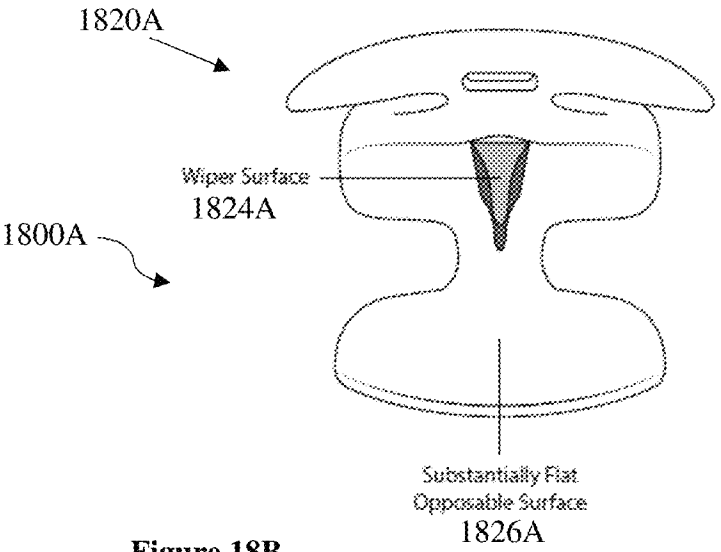

FIG. 18B depicts a front perspective view of apparatus 1800A. From this perspective, it is clear that wiper surface 1824A is disposed substantially inline and along a central axis of portion 1820A. It is also contemplated that the wiper surface of some embodiments is disposed at an angle as previously described.

Figure 19A:
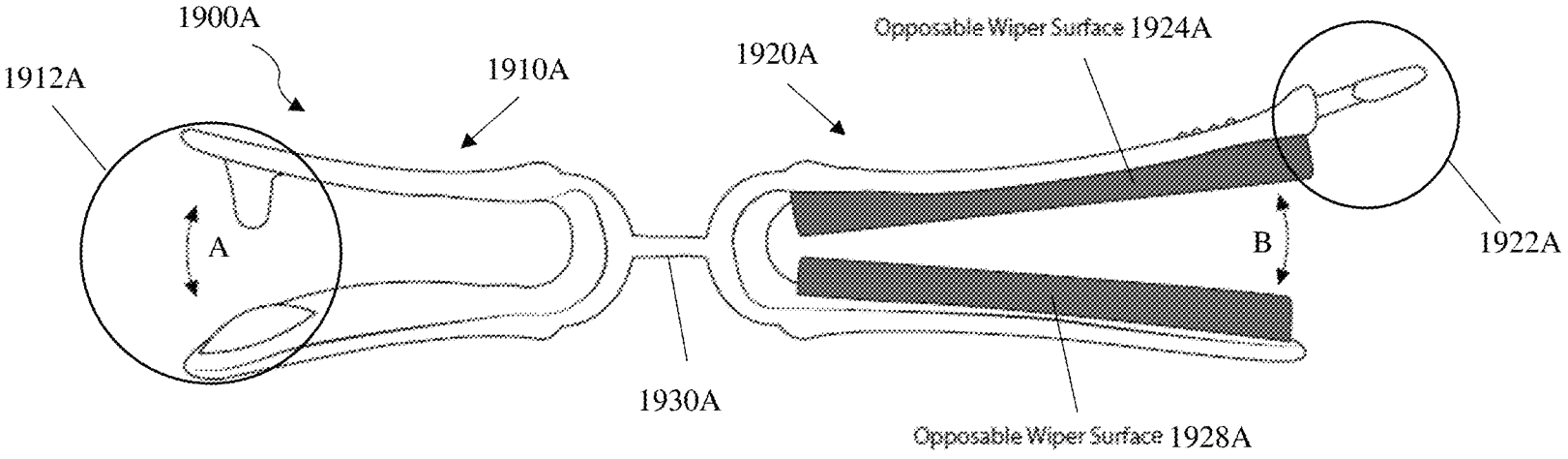
FIGS. 19A-B depicts yet another embodiment of a bag cutter with dual wipers.

FIG. 19A depicts another embodiment of a cutting device of the inventive subject matter. Apparatus 1900A includes portion 1910A connected to portion 1920A by connector 1930A. Portion 1910A includes region 1912A, and portion 1920A includes region 1922A, and opposed wiper surface 1924A, with each element similar to the description above for FIGS. 18A-B. Apparatus 1900A further includes opposed wiper surface 1928A disposed along the inner surface of the lower arm of portion 1920A. It is contemplated that apparatus 1900A be used in similar fashion as described above for apparatus 1800A.

Figure 19B:
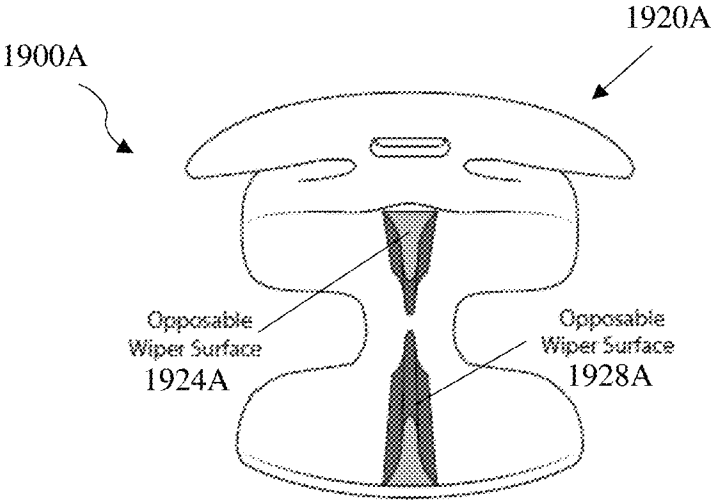

FIG. 19B depicts a front perspective view of apparatus 1900A, showing that opposed wiper surfaces 1924A and 1928A are disposed inline and down the center of portion 1920A. However, it is contemplated that some embodiments have wiper surfaces disposed at an angle as previously discussed.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cutting apparatus, comprising:

a first arm having a first inner surface, and an opposable second arm having a second inner surface opposite the first inner surface;

a first blade partially embedded in and extending from the first arm;

a cutting surface extending from the second arm toward the first blade;

a first piercer and a second piercer, each extending outward from an edge of the first arm, and the first piercer having a first tip, wherein the first tip extends toward the second piercer;

a second blade positioned between the first piercer and the edge of the first arm;

a third blade positioned between the second piercer and the edge of the first arm; and wherein an angle between a cutting edge of the second blade and a cutting edge of the third blade is less than or greater than 180°.

2. The apparatus of claim 1, wherein the first piercer extends toward the second surface.

3. The apparatus of claim 1, wherein the first piercer extends away from a space between the first and second arms.

4. The apparatus of claim 1, wherein the first piercer extends toward a space between the first and second arms.

5. The apparatus of claim 1, wherein the first piercer and the second piercers each has a substantially mirrored shape with respect to each other.

6. The apparatus of claim 1, wherein the second blade bridges a gap between the first piercer and the edge of the first arm.

7. The apparatus of claim 1, wherein the second arm has a breadth, and the first piercer extends beyond the breadth of the second arm.

8. The apparatus of claim 1, wherein the second arm has a breadth, and the first piercer extends within the breadth of the second arm.

* * * * *